US006832564B2

(12) United States Patent
Hutmacher et al.

(10) Patent No.: US 6,832,564 B2
(45) Date of Patent: Dec. 21, 2004

(54) METHOD OF OPERATING A MULTIPLE HEARTH FURNACE

(75) Inventors: Patrick Hutmacher, Bettembourg (LU); Pascal Ferretti, Differdange (LU); Steve Arendt, Tetange (LU); Emile Lonardi, Bascharage (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 10/476,113

(22) PCT Filed: Apr. 25, 2002

(86) PCT No.: PCT/EP02/04586

§ 371 (c)(1),
(2), (4) Date: Oct. 24, 2003

(87) PCT Pub. No.: WO02/086406

PCT Pub. Date: Oct. 31, 2002

(65) Prior Publication Data

US 2004/0123785 A1 Jul. 1, 2004

(30) Foreign Application Priority Data

Apr. 25, 2001 (LU) ..... 90766

(51) Int. Cl.[7] ..... F23B 7/00; C21B 11/08

(52) U.S. Cl. ..... 110/341; 110/208; 110/225; 110/228; 75/483

(58) Field of Search ..... 75/483, 484; 432/138, 432/139, 208, 209, 225; 110/208, 209, 225, 228, 247, 295, 347, 341

(56) References Cited

U.S. PATENT DOCUMENTS 723,251 A * 3/1903 Doremus ..... 432/138
1,549,379 A * 8/1925 Pike ..... 432/82
2,089,782 A * 8/1937 Carlsson ..... 75/10.38
2,511,281 A 6/1950 Martin
3,998,703 A 12/1976 Harrell
4,248,164 A * 2/1981 Isheim ..... 110/225
5,080,025 A * 1/1992 Nell et al. ..... 110/247
5,752,452 A * 5/1998 Leger ..... 110/346
6,451,086 B2 * 9/2002 Hansmann et al. ..... 75/483
6,464,752 B1 * 10/2002 Roth et al. ..... 75/483

FOREIGN PATENT DOCUMENTS

FR 514977 3/1921
FR 2368678 5/1978

* cited by examiner

*Primary Examiner*—Kenneth Rinehart
(74) *Attorney, Agent, or Firm*—McCormick Paulding & Huber LLP

(57) ABSTRACT

A method of operating a multiple hearth furnace with a plurality of vertically aligned hearth floors includes feeding a first material onto the uppermost hearth floor and moving it over the hearth floor before it falls through a drop hole onto the next lower hearth floor. The first material is processed in this way from hearth floor to hearth floor to the lowermost hearth floor. A second material is fed onto one of the hearth floors to be mixed into the first material. This second material is moved separately from the first material in a separate annular zone of the hearth floor onto which it is fed before it is mixed into the first material, providing an efficient thermal preconditioning of the second material prior to mixing it with the first material without requiring any supplemental equipment.

15 Claims, 2 Drawing Sheets

METHOD OF OPERATING A MULTIPLE HEARTH FURNACE

CROSS-REFERENCE TO RELATED APPLICATIONS

This application is entitled to the benefit of and incorporates by reference in their entireties essential subject matter disclosed in International Application No. PCT/EP02/04586 filed on Apr. 25, 2002, and Luxembourg Patent Application No. 90 766 filed on Apr. 25, 2001.

FIELD OF THE INVENTION

The present invention relates to a method of operating a multiple hearth furnace.

BACKGROUND OF THE INVENTION

A multiple hearth furnace comprises an upright cylindrical furnace housing that is divided by a plurality of vertically spaced hearth floors in vertically aligned hearth chambers. A vertical shaft extends axially though the cylindrical furnace housing, passing centrally through each hearth floor. In each hearth chamber at least one rabble arms is secured to the vertical shaft and extends radially outside therefrom over the hearth floor. These rabble arms are provided with rabble teeth, which extend down into the material being processed on the respective hearth floor. As the vertical shaft rotates, the rabble arms move over the material on their respective hearth floor, wherein their rabble teeth plough through the material. The orientation of the rabble teeth of a rabble arm is such that they confer to the material a circumferential and a radial motion component, wherein the radial motion component is either centripetal (i.e. the material will be moved radially inwardly towards the vertical shaft) or centrifugal (i.e. the material will be moved radially outwardly towards the outer shell of the furnace). Drop holes are provided in each hearth floor, alternately in the inner zone of the hearth floor (i.e. centrally around the vertical shaft) or in the outer zone of the hearth floor (i.e. peripherally around the outer shell of the furnace). On hearth floors with a central drop hole, the rabble arms urge the material from the outer periphery of the hearth floor radially inwardly. On hearth floors with a peripheral drop hole, the rabble arms urge the material from the inner periphery of the hearth floor radially outwardly.

Operation of such a multiple hearth furnace takes place in the following manner. Solid material to be processed is supplied continuously via a material feed inlet into the uppermost hearth chamber, where it falls for example upon the outer periphery of the uppermost furnace floor. As the vertical shaft rotates, the rabble arms in the uppermost hearth chamber gradually urge the material in a kind of spiral movement over the hearth floor towards a central drop hole surrounding the vertical shaft. Through this central drop hole the material drops down onto the second hearth floor in the second hearth chamber, where the rabble arms of this chamber gradually work the material toward the outer periphery of the second hearth floor. Here the material drops through the peripheral drop holes of this second hearth floor onto the third hearth floor in the third hearth chamber. The material is then worked in the same way through successive hearth chambers, before it ultimately leaves the furnace via a material outlet in the hearth floor of the lowermost hearth chamber. Process gases move in an ascending counter-flow through the multiple hearth furnace. As the material travels downwards from hearth floor to hearth floor, it is thoroughly stirred and exposed to the hot process gases.

To optimise the process in the multiple hearth furnace, it is often of interest to feed additional material, e.g. a reducing agent as coal, on a lower hearth floor. This additional material is usually discharged by a conveyor through the outer shell of the furnace on a peripheral area of a hearth floor with a central drop hole (i.e. the rabble arms are consequently designed to urge the solid material radially inwardly, and the hearth floor immediately above has consequently peripheral drop holes). The rotating rabble arms urge the material falling through the peripheral drop holes of the next higher hearth floor and the additional material discharged by the conveyor through the outer shell of the furnace together to the central drop hole. Due to the ploughing action of the rabble teeth, both materials are thoroughly mixed before they fall through the central drop hole on the next lower hearth floor.

In many cases it would be of interest—at least from the point of view of process optimisation—to thermally precondition the additional material before adding it to the material already processed on upper hearth floors. Such a thermal preconditioning can for example comprise a preheating of the additional material to avoid an inhomogeneous temperature profile in the material bed, a preheating to dry the additional material or to evaporate other volatile components. However, in practice such a thermal preconditioning is generally not carried out, because it is considered to be too expensive in comparison to its benefits.

OBJECT AND SUMMARY OF THE INVENTION

A problem addressed by the present invention is to provide a simple and inexpensive method for thermally preconditioning a additional solid material prior to adding it to a material already processed on upper hearth floors of a multiple hearth furnace.

SUMMARY OF THE INVENTION

In accordance with the present invention, a method of operating multiple hearth furnace with a plurality of vertically aligned hearth floors, comprises in particular following steps. A first material is fed onto the uppermost hearth floor and moved over this uppermost hearth floor before it falls through a drop hole onto the next lower hearth floor. This first material is processed in this way from hearth floor to hearth floor down to the lowermost hearth floor. A second material is fed onto one of the hearth floors to be mixed into the first material. In accordance with an important aspect of the present invention, the second material is moved separately from the first material in a separate annular zone of the hearth floor onto which it is fed before it is mixed into the first material. It will be appreciated that this method allows to provide an efficient thermal preconditioning of the second material prior to mixing it into the first material without requiring any supplementary equipment therefore.

In a generally preferred implementation of the method, the second material is fed onto an outer annular zone of a hearth floor, and the first material is dropped from a higher hearth floor onto an inner annular zone of this hearth floor. The first material is then moved in the inner annular zone of the hearth floor, and the second material is moved in the outer annular zone surrounding the first material in the inner annular zone. It will be appreciated that this way of proceeding allows to easily feed the second material through a lateral outer wall of the furnace onto the respective hearth floor.

For process reasons it may be of interest to keep the first and second material separate until they are dropped onto the next hearth floor. If this is the case, the second material is e.g. advantageously fed onto the outer periphery of the outer annular zone and moved inwardly towards the inner annular zone; whereas the first material is dropped onto the inner periphery of the inner annular zone and moved outwardly towards the outer annular zone. The first material and the second material can then be dropped through at least one common drop hole located in a fringe range between the inner and outer annular zones.

The first material and the second material may be dropped through the at least one common drop hole either onto an inner zone or onto an outer zone of a lower hearth floor. Here they are mixed by moving them from the inner zone to the outer zone, respectively from the outer zone to the inner zone, e.g. by means of rotating rabble arms as commonly used in multiple hearth furnaces.

The same rabble arms may be used for moving the first material in the inner zone and the second material in the outer zone. In the inner zone, the rabble teeth are then arranged so as to move the first material outwardly. In the outer zone, the rabble teeth are then arranged so as to move the second material inwardly.

In an alternative implementation of the method in accordance with the present invention, the second material is fed onto an inner annular zone of a hearth floor and moved herein, and the first material is dropped onto an outer annular zone of the hearth floor and moved herein around the second material in the inner annular zone of the hearth floor. This implementation is of particular interest if the second material can be easily fed, e.g. by means of a cooled conveyor radially introduced into the hearth chamber or through a hollow central shaft of the multiple hearth furnace, onto the inner periphery of the inner annular zone.

If it is of interest to keep, in the above alternative implementation, the first and second material separate until they are dropped onto the next hearth floor, then it is of advantage to proceed as follows. The first material is dropped onto the outer periphery of the outer annular zone and moved inwardly towards the inner annular zone. The second material is the fed onto the inner periphery of the inner annular zone and moved outwardly towards the outer annular zone. The first material and the second material are dropped through at least one common drop hole located in a fringe range between the inner and outer annular zones. If rabble arms with rabble teeth are used for moving the first material and the second material, then it is sufficient to arrange the rabble teeth in the inner zone so as to move the second material outwardly and the rabble teeth in the outer zone so as to move the first material inwardly.

It will be appreciated that the above described method of operating a multiple hearth furnace can be advantageously used within the context of a process for recovering metals from dusts and sludges, including inter alia important amounts of iron, zinc and lead. Such a process is advantageously carried out in a multiple hearth furnace comprising a first furnace stage and a second furnace stage. Separate furnace atmospheres prevail in each furnace stage, and each stage has a plurality of vertically aligned hearth floors. The first material, i.e. the material that is fed onto the uppermost hearth floor of the first furnace stage, is a material comprising the metal oxides. The second material, that is the additional material that is fed onto one of the hearth floors, is a coal with volatile constituents. The first material is first subjected to mainly endothermic preconditioning processes in the first furnace stage. The coal is fed onto the lowermost hearth floor of the first furnace stage and moved thereon separately from the first material in a separate annular zone of this hearth floor, wherein most of its volatile constituents are driven off and burned in the first furnace stage. The preconditioned first material and the preconditioned coal are then fed through at least one material lock onto the uppermost hearth floor of the second furnace stage and thoroughly mixed thereon, so that the metal oxides are subjected to a reduction by the preconditioned coal. It will be appreciated that this method of operating the double stage hearth furnace allows to substantially improve the thermal balance of the process by using the combustion energy of the volatile constituents of the coal for the endothermic processes in the first furnace stage. At the same time it helps to avoid a start of the exothermic reduction process in the first furnace stage, which would disturb the separation result by reducing and evaporating e.g. the zinc in the first furnace stage instead of the second furnace stage. Furthermore, the method warrants an excellent preconditioning of the coal for the reduction process in the second furnace stage.

If the preconditioned second material can be mixed into the first material already on the hearth floor onto which the second material is fed, then it may be of advantage to proceed in accordance with one of the following implementations of the method in accordance with the invention. According to a first implementation, the second material is fed onto the outer periphery of the outer annular zone and moved separately inwardly towards the inner annular zone, where it is transferred from the outer annular zone into the outer periphery of the inner annular zone. The first material is dropped onto the outer periphery of the inner annular zone and moved together with the second material inwardly through the inner annular zone, wherein both materials are thoroughly mixed. The mixed materials are finally dropped through at least one common drop hole at the inner periphery of the inner annular zone. According to a second implementation, the second material is fed onto the inner periphery of the inner annular zone and moved separately outwardly towards the outer annular zone, where it is transferred from the inner annular zone into the inner periphery of the outer annular zone. The first material is dropped onto the inner periphery of the outer annular zone and moved together with the second material outwardly through the outer annular zone, wherein both materials are thoroughly mixed. The mixed materials are finally dropped through at least one common drop hole at the outer periphery of the outer annular zone.

BRIEF DESCRIPTION OF THE DRAWINGS

Methods of operating a multiple hearth furnace in accordance with the present invention will now be described by way of illustration, in particular with reference to the multiple hearth furnace shown in the accompanying drawings, in which.

DETAILED DESCRIPTION OF THE INVENTION

Figure 1:
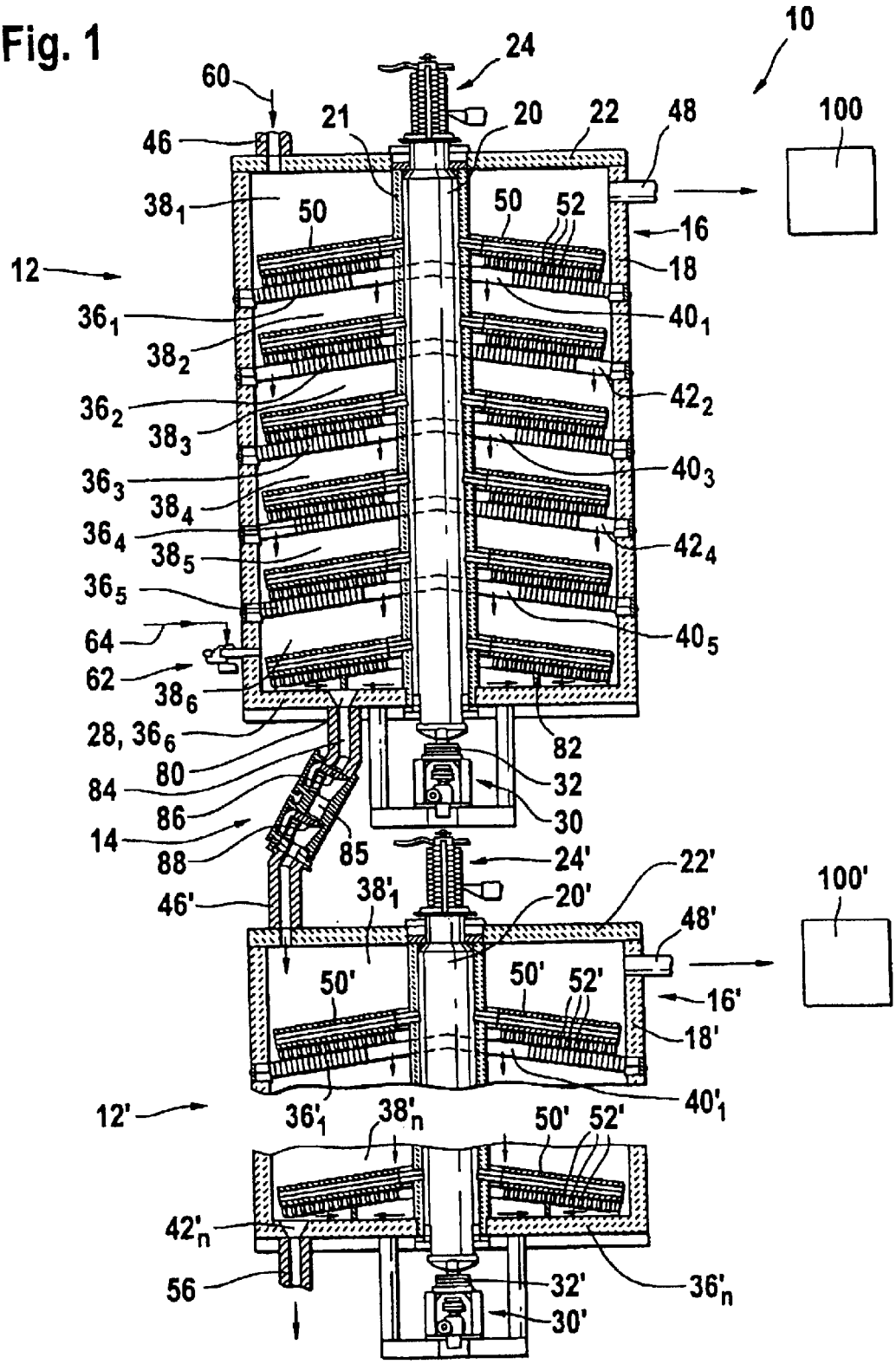
FIG. 1: is a schematic vertical section through a multiple hearth furnace with two separate furnace stages, each furnace stage having a plurality of vertically aligned hearth floors.

The multiple hearth furnace 10 shown in FIG. 1 has a first furnace stage 12 which is connected to a second furnace stage 12' by means of a gas-tight material lock 14. It will be noted that the second furnace stage 12' is only shown in part.

The first furnace stage will now be described in detail. It comprises an outer shell 16 of a generally cylindrical configuration with a refractory lining 18. This outer shell 16 is mounted upright on a support structure (not shown) and surrounded by a framework of structural steel (not shown). A vertical rotary shaft 20, which is sheathed with a refractory lining 21, extends axially through the cylindrical outer shell 16. Its upper end protrudes above a refractory ceiling 22 of the outer shell 16, where it is radially guided in upper bearing means 24. Its lower end extends beneath a refractory floor 28 of the outer shell 16, where it engages lower support and bearing means 30. Reference number 32 identifies a rotary drive means for driving the vertical rotary shaft 20 in rotation.

The interior of the outer shell 16 is divided by means of five intermediary hearth floors $\mathbf{36}_1$, $\mathbf{36}_2$, $\mathbf{36}_3$, $\mathbf{36}_4$, $\mathbf{36}_5$ in sixth hearth chambers $\mathbf{38}_1$, $\mathbf{38}_2$, $\mathbf{38}_3$, $\mathbf{38}_4\mathbf{38}_5$, $\mathbf{36}_6$. Each of the hearth floors $\mathbf{36}_1$, $\mathbf{36}_2$, $\mathbf{36}_3$, $\mathbf{36}_4$, $\mathbf{36}_5$ is made of a refractory material and is pre-stressed so as to be self-supporting within the outer shell 16. The hearth floor of the sixth hearth chamber $\mathbf{38}_6$ is formed by the furnace floor 28, which is identified by reference number $\mathbf{36}_6$ in its function as lowermost hearth floor of the first furnace stage 12. Central drop holes $\mathbf{40}_1$, $\mathbf{40}_3$ and $\mathbf{40}_5$ are formed in the alternate hearth floors $\mathbf{36}_1$, $\mathbf{36}_3$ and $\mathbf{36}_5$ around the vertical rotary shaft 20. Peripheral drop holes $\mathbf{42}_2$ and $\mathbf{42}_4$ are formed in the intermediate hearth floors $\mathbf{36}_2$ and $\mathbf{36}_4$ around the outer shell 16. A material feed inlet 46 is arranged in the ceiling 22 at the outer periphery of the latter, for feeding a first solid material on the uppermost hearth floor $\mathbf{36}_1$ of the first furnace stage 12. Reference number 48 identifies an outlet for the process gases in the upper-most hearth chamber $\mathbf{38}_1$ of the first furnace stage 12. It will be noted that the first furnace stage 12 further comprises burners, which are not shown in the schematic section of FIG. 1.

In each hearth chamber $\mathbf{38}_i$, a plurality of rabble arms 50 are supported by the vertical rotary shaft 20 so as to extend radially therefrom over the respective hearth floor $\mathbf{36}_i$. The multiple hearth furnace 10 of FIG. 1 has for example four equally spaced rabble arms 50 in each hearth chamber $\mathbf{38}_i$. Each of these rabble arms 50 supports a plurality of rabble teeth 52 which extend downward towards an upper surface 54 of the hearth floor 36. As the vertical shaft 20 rotates, the rabble arms 50 move over the material on the respective hearth floor $\mathbf{36}_i$, 28, wherein the rabble teeth 52 plough through the material on the hearth floor $\mathbf{36}_i$. The rabble teeth 20 are arranged on the rabble arm 16 so that substantially every point of the hearth floor $\mathbf{36}_1$ is passed over by a rabble tooth 52. The orientation of the rabble teeth 52 of a rabble arm 50 is such that they confer to the material a circumferential and a radial motion component, wherein the radial motion component is either centripetal (i.e. the material will be moved radially inwardly towards the vertical shaft) or centrifugal (i.e. the material will be moved radially outwardly towards the outer shell of the furnace). In particular, in the hearth chambers $\mathbf{38}_1$, $\mathbf{38}_3$ and $\mathbf{38}_5$, the orientation of the rabble teeth 52 is such that the material will be moved from the periphery of the. hearth floors $\mathbf{36}_1$, $\mathbf{36}_3$, $\mathbf{36}_5$ radially inwardly toward the central drop holes $\mathbf{40}_1$, $\mathbf{40}_3$, $\mathbf{40}_5$ in the hearth floors $\mathbf{36}_1$, $\mathbf{36}_3$, $\mathbf{36}_5$. In the hearth chambers $\mathbf{38}_2$ and $\mathbf{38}_4$, the orientation of the rabble teeth 52 is such that the material will be moved radially outwardly toward the peripheral drop holes $\mathbf{42}_2$ and $\mathbf{42}_4$ in the hearth floors $\mathbf{36}_2$ and $\mathbf{36}_4$. Material handling in the lowermost hearth chamber $\mathbf{38}_6$ is in direct relation with the method of the present invention and will be described further down.

The second furnace stage 12' is of substantially the same design as the first furnace stage 12. Elements and features of the second furnace stage 12' are identified in FIG. 1 with the same reference numbers as their equivalents in the first furnace stage 12, wherein a prime symbol is added to the respective reference number of the second furnace stage 12'. It will be noted that the second furnace stage 12' may have either the same number or a different number of hearth chambers $\mathbf{38'}_i$ than the first furnace stage 12. In FIG. 1 only the uppermost hearth chamber $\mathbf{38'}_1$ and the lowermost hearth chamber $\mathbf{38'}_n$ of the second furnace stage 12' are shown. The uppermost hearth floor is identified with reference numbers $\mathbf{36'}_1$ and the lowermost hearth floor with reference number $\mathbf{36'}_n$. It remains to be pointed out that in the lowermost hearth chamber $\mathbf{38'}_n$, the orientation of the rabble teeth 52' of the rabble arms 50' is such that the material will be moved radially outwardly towards a peripheral drop hole $\mathbf{42}_n$, through which material falls into an outlet tube 56.

Operation of the first furnace stage 12 as thus far described takes place in the following manner. A first solid material 60 is supplied via the material feed inlet 46 into the first hearth chamber $\mathbf{38}_1$, where it falls upon the outer periphery of the first furnace floor $\mathbf{36}_1$. As the vertical shaft 20 rotates, the rabble arms 50 in the first hearth chamber $\mathbf{38}_1$ gradually urge the material over the first hearth floor $\mathbf{36}_1$ towards the central drop hole $\mathbf{40}_1$ in the latter. Through this central drop hole $\mathbf{40}_1$ the material drops down onto the second hearth floor $\mathbf{36}_2$ in the second hearth chamber $\mathbf{38}_2$, where the rabble arms 50 of this chamber gradually work the material toward the outer periphery. Here the material drops through the peripheral drop holes $\mathbf{42}_2$ of this hearth floor $\mathbf{36}_2$ onto the third hearth floor $\mathbf{36}_3$ in the third hearth chamber $\mathbf{38}_3$. The material is then worked in the same way through the fourth and the fifth hearth chambers $\mathbf{38}_4$, $\mathbf{38}_5$, before it falls through the central drop hole $\mathbf{40}_5$ in the fifth hearth floor $\mathbf{36}_5$ onto the inner periphery of the sixth, i.e. the lowermost, hearth floor $\mathbf{36}_6$. Process gases move in an ascending counter-flow through the multiple hearth furnace 10. As the material travels downward from hearth floor to hearth floor, it is thoroughly stirred and exposed to the hot process gases.

Figure 2:
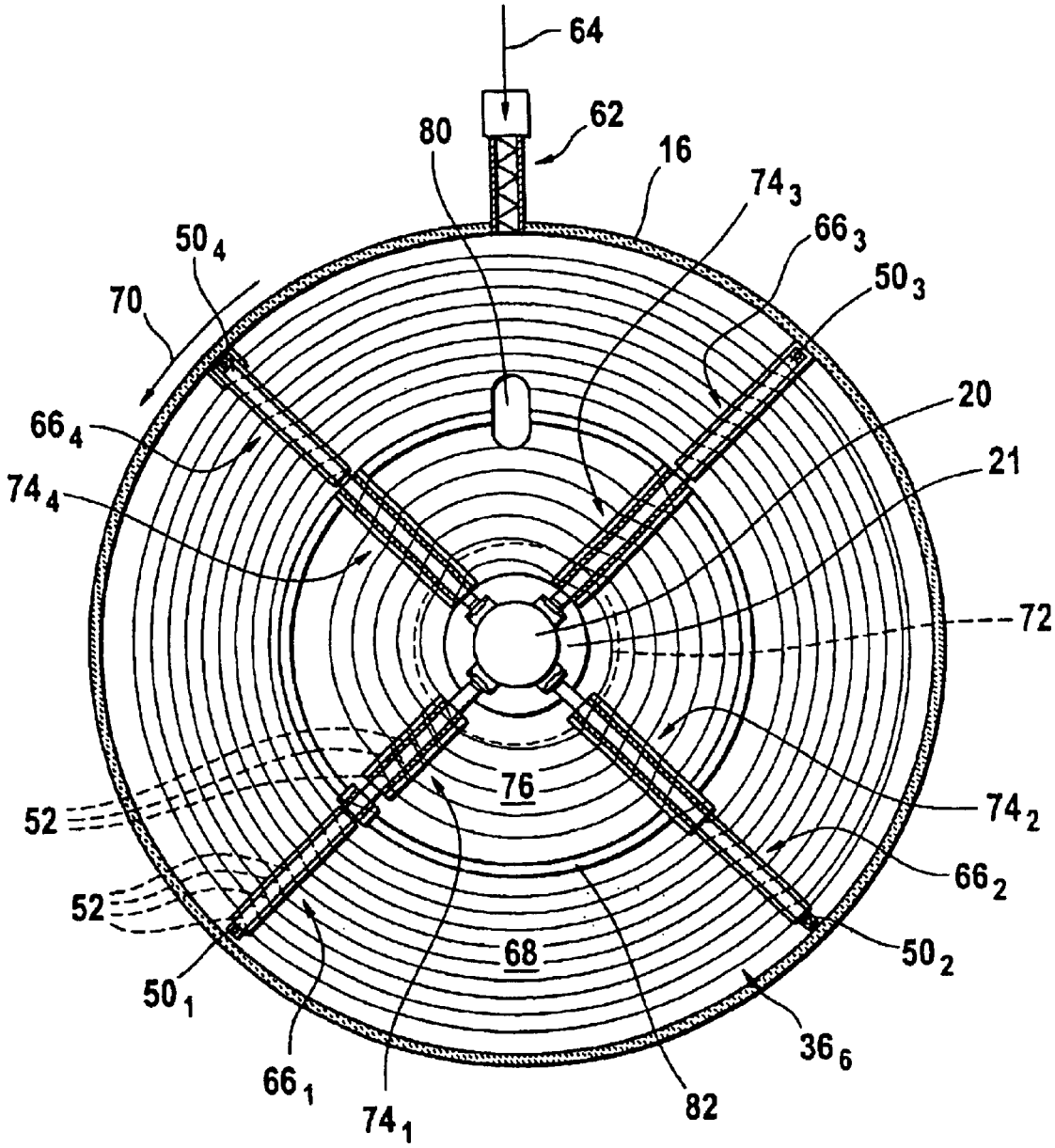
FIG. 2: is a top view on the lowermost hearth floor of the first furnace stage.

Material handling in the lowermost hearth chamber $\mathbf{38}_6$ of the first furnace stage 12 will now be described in detail, referring simultaneously to FIGS. 1 & 2, wherein FIG. 2 shows a top view of the lowermost hearth floor $\mathbf{36}_6$ with its four rabble arms $\mathbf{50}_1$, $\mathbf{50}_2$, $\mathbf{50}_3$, $\mathbf{50}_4$. Arrow 70 indicates the sense of rotation of these four rabble arms $\mathbf{50}_i$.

A conveyor 62, for example a worm conveyor, is used to feed a second solid material 64 through the cylindrical outer shell 16 onto the outer periphery of the lowermost hearth floor $\mathbf{36}_6$. This second material 64 is urged by outer segments $\mathbf{66}_1$, $\mathbf{66}_2$, $\mathbf{66}_3$, $\mathbf{66}_4$ of the rabble arms $\mathbf{50}_1$, $\mathbf{50}_2$, $\mathbf{50}_3$, $\mathbf{50}_4$ over an outer annular zone 68 of the hearth floor $\mathbf{36}_6$. The orientation of the rabble teeth 52 of these outer segments $\mathbf{66}_i$ of the rabble arms 50 is such that they generate a material movement with a centripetal component, i.e. they urge the material gradually towards the center of the hearth floor $\mathbf{36}_6$. As already mentioned above, the first material 60 falls through the central drop hole $\mathbf{40}_5$ in the fifth hearth floor $\mathbf{36}_5$ (the border of this drop hole $\mathbf{40}_5$ is shown with a dotted line 72 in FIG. 2) onto the inner periphery of the hearth floor $\mathbf{36}_6$. Here this first material 60 is urged by inner segments $\mathbf{74}_1$, $\mathbf{74}_2$, $\mathbf{74}_3$, $\mathbf{74}_4$ of the rabble arms $\mathbf{50}_1$, $\mathbf{50}_2$, $\mathbf{50}_3$, $\mathbf{50}_4$ over an inner annular zone 76 of the hearth floor $\mathbf{36}_6$. The orientation of the rabble teeth 52 of these inner segments $\mathbf{74}_i$ of the rabble arms 50 is such that they generate a material movement with a centrifugal component, i.e. they urge the material gradually towards the periphery of the hearth floor $\mathbf{36}_6$. In the fringe range between the inner annular zone 76 and the outer annular zone 68 there is at least one common drop hole 80 for the first material 60 and the second material 64. This common drop hole 80 has an oblong shape extending radially into the inner periphery of the outer annular zone 68, to receive the second material 64, and into the outer periphery of the inner annular zone 76, to receive the first material 60. It will be noted that it may be of advantage to distribute several drop holes circumferentially in the fringe range between the inner annular zone 76 and the outer annular zone 68, so as to achieve a more uniform evacuation of both materials over the hearth floor $\mathbf{36}_6$. Reference number 82 identifies a optional small partition wall, which separates the outer annular zone 68, in which the second material 64 is urged inwardly by the outer segments $\mathbf{66}_i$ of the rabble arms $\mathbf{50}_i$, from the inner annular zone 76, in which the first material 60 is urged outwardly by the outer segments $\mathbf{66}_i$ of the rabble arms $\mathbf{50}_i$. The object of this partition wall 82 is to avoid, as well as possible, a mixing of the first material 60 and the second material 64 on the hearth floor $\mathbf{36}_6$. Special rabble teeth 52 may associated with the partition wall 82 so as avoid, as well as possible, an overflow of material over the partition wall 82.

While being urged by the outer segments $\mathbf{66}_1$, $\mathbf{66}_2$, $\mathbf{66}_3$, $\mathbf{66}_4$ of the rabble arms $\mathbf{50}_1$, $\mathbf{50}_2$, $\mathbf{50}_3$, $\mathbf{50}_4$ over the outer annular zone 68 of the hearth floor $\mathbf{36}_6$ towards the drop hole 80, the second material 64 is subjected to an efficient thermal preconditioning. Such a thermal preconditioning may for example comprise a drying of the second material (i.e. an evaporation of water), an evaporation of other volatile components or simply a preheating of the second material to avoid a temperature drop of the first material 60 when both materials are mixed together.

Through the common drop hole 80 the first material 60 and the second material 64 drop into an outlet tube 84, which is connected to the inlet side of the aforementioned gas-tight material lock 14. The latter has a lock chamber 85 with a gas-tight inlet flap 86 and a gas tight outlet flap 88. During charging of the gas-tight material lock 14, the inlet flap 86 is completely open and the outlet flap 88 is completely closed. During emptying of the gas-tight material lock 14, the inlet flap 86 is completely closed and the outlet flap 88 is completely open. As soon as a column of material in the outlet tube 84 exercises a predetermined weight force onto the inlet flap 86, the latter opens an the outlet tube 84 empties into the lock chamber 85, wherein the outlet flap 88 is completely closed. Thereafter the inlet flap 86 immediately closes. As soon as the inlet flap 86 is closed, the outlet flap 88 opens and the lock chamber 85 empties through a material inlet tube 46' into the uppermost hearth chamber $\mathbf{38'}_1$ of the second furnace stage 12'. The first material 60 and the second material 64 fall together upon the outer periphery of the first furnace floor $\mathbf{36'}_1$. As the vertical shaft 20' rotates, the rabble arms 50' in the first hearth chamber $\mathbf{38'}_1$ gradually urge both materials 60, 64 together over the first hearth floor $\mathbf{36'}_1$ towards the central drop hole $\mathbf{40'}_1$ in the latter. It will be appreciated that by ploughing both materials with the rabble arms 50 from the outer zone to the inner zone of this hearth floor $\mathbf{36}_1$, both materials 60, 64 are thoroughly mixed. The mixed materials 60, are then worked, as described above, through the subsequent hearth chambers $\mathbf{38'}_2 \ldots \mathbf{38'}_n$ of the second furnace stage 12', before the processed material ultimately leaves the second furnace stage 12' via the drop hole $\mathbf{42'}_n$ in the lowermost hearth floor $\mathbf{36}_n$.

It will be appreciated that the above described method of operating a multiple hearth furnace is e.g. particularly advantageous if used within the context of a process for recovering metals from dusts and sludges including important amounts of iron, zinc and lead. Such dusts and sludges are e.g. obtained. as by-products in iron and steel making processes and their recycling is a well known ecoproblem.

In the method of the present invention, these dusts and sludges represent the first material 60, which is charged into the uppermost hearth chamber $\mathbf{38}_1$ of the first furnace stage 12. In this first furnace stage 12, the first material 60 descending from furnace chamber to furnace chamber is subjected to mainly endothermic preconditioning processes, such as drying, evaporation of organic substances (e.g. oils) and evaporation of lead and alkalis. The products that are evaporated in the first furnace stage 12 (i.e. mainly water, oils, lead and alkalis) are evacuated with the exhaust gases of this first stage through the exhaust gas outlet 48 into an exhaust gas conditioning plant 100 associated with the first furnace stage 12. The heat required for the endothermic processes in the first furnace stage 12 has to be provided by burners.

A coal rich in volatile constituents is fed as second material 64 by the conveyor 62 through the cylindrical outer shell 16 onto the outer periphery of the lowermost hearth floor $\mathbf{36}_6$ of the first furnace stage 12. While this coal 64 is urged over the outer annular zone 68 of the hearth floor $\mathbf{36}_6$, its volatile constituents evaporate and burn, thereby providing an important contribution to the heat input required by the endothermic processes which take place in the first furnace stage 12. Indeed, the combustion gases resulting from the combustion of the volatile coal constituents above the outer annular zone 68 of the lower-most hearth floor $\mathbf{36}_1$ contribute to a heat up of the descending first material 60 during their ascending movement towards the exhaust gas outlet 48 in the upper hearth chamber $\mathbf{38}_1$.

Because the coal 64 is not mixed with the material 60 on the hearth floor $\mathbf{36}_6$, no reduction process takes place in the first furnace stage 12. Thus it is efficiently prevented that metallic zinc is formed and evaporated in the first furnace stage 12. This zinc would indeed be evacuated with the exhaust gases of the first furnace stage 12, which would have as a drawback that it could no longer be recovered separately from the less valuable lead and alkalis.

The reduction of the zinc and the iron oxides starts only in the second furnace stage 12' when the preconditioned coal 64 is mixed into the preconditioned first material 60 on the first hearth floor $\mathbf{36'}_1$ of the second furnace stage 12'. This reduction process is highly exothermic. The zinc oxides are reduced to metallic zinc, which evaporates instantaneously, is evacuated with the exhaust gases of the second furnace stage 12', is again oxidised and is finally recovered as solidified zinc oxide in an exhaust gas conditioning plant 100' connected to the exhaust gas outlet 48' of the second furnace stage 12'. The iron oxides contained in the first material 60 are processed in the second furnace stage 12' into a direct reduced iron (DRI), which is collected at the outlet 56 of the second furnace stage 12'.

It remains to be pointed out that feeding the coal directly into the upper-most hearth chamber $\mathbf{38'}_1$ of the second furnace stage 12' would result in that the volatile constituents of the coal are directly evacuated with the exhaust gases of the second furnace stage 12', without having a positive contribution to the thermal balance of the multiple hearth furnace. It will therefore be appreciated that the above method of operating the multiple hearth furnace allows to substantially improve the thermal balance of the process.

It will be appreciated that the above described handling of the second material 64 is particularly advantageous if it is of interest not to mix the first and second materials 60, 64 on the same hearth floor onto which the second material 64 is fed. If the preconditioned second material 64 may be mixed into the first material 60 on the same hearth floor onto which the second material 64 is fed, the method can e.g. be modified as follows. While the second material 64 is still fed onto the outer periphery of the outer annular zone 68 and separately moved inwardly towards the inner annular zone 76, it is no longer dropped through a drop hole in the fringe zone between the outer and the inner annular zone, but transferred from the outer annular zone 68 into the outer periphery of the inner annular zone 76 (the partition wall 82 is of course eliminated). The first material 60 is dropped onto the outer periphery of the inner annular zone 76 (e.g. through a central drop hole with a bigger diameter or by means of chutes associated with peripheral drop holes in the next higher hearth floor). From this outer periphery of the inner annular zone 76, the rabble arms 50 move both materials together inwardly and mix them thoroughly, before the mixed materials fall through at least a common drop hole arranged around the vertical shaft 20. A similar result may be achieved by feeding the second material (e.g. by means of a cooled screw conveyor radially penetrating into the hearth chamber) onto the inner periphery of the inner annular zone 76 and moving it separately outwardly towards the outer annular zone 68. In this case the first material is fed onto the inner periphery of the outer annular zone 68, and the second material is transferred from the inner annular zone 76 into the inner periphery of the outer annular zone 68. In this outer annular zone 68 the rabble arms 50 move both materials together outwardly so as to mix both materials in the outer annular zone 68. The mixed materials are then dropped through at least one common drop hole located at the outer periphery of the outer annular zone 68.

In the above examples, the second material 64 is always evacuated through a common drop hole together with the first material 60. It will be noted that it is also possible to evacuate the first and the second material through separate drop holes. This is for example of advantage if the preconditioning of the second material 64 requires more space than available in the separate annular zone of the hearth floor onto which it is fed. In this case the second material 64 can be separately dropped onto a lower hearth floor and moved thereon separately from the first material 60 in further separate annular zone just as described above. This operation may of course be repeated on several hearth floors, until the second material 64 is ready to be mixed into the first material 60.

What is claimed is:

1. A method of operating a multiple hearth furnace with a plurality of vertically aligned hearth floors, comprising following steps:

feeding a first material onto the uppermost hearth floor;

moving said first material over said uppermost hearth floor before it falls through a drop hole onto the next lower hearth floor;

processing said first material in this way from hearth floor to hearth floor down to the lowermost hearth floor;

feeding a second material onto one of said hearth floors; and mixing said second material into said first material;

moving said second material separately from said first material in a separate annular zone of the hearth floor onto which it is fed.

2. The method as claimed in claim 1, comprising following steps:

feeding said second material onto an outer annular zone of a hearth floor;

dropping said first material onto an inner annular zone of said hearth floor;

moving said first material in said inner annular zone of said hearth floor; and moving said second material in said outer annular zone surrounding said first material in said inner annular zone.

3. The method as claimed in claim 2, comprising following steps:

feeding said second material onto the outer periphery of said outer annular zone;

moving said second material in said outer annular zone inwardly towards said inner annular zone;

dropping said first material onto the inner periphery of said inner annular zone;

moving said first material in said inner annular zone outwardly towards said outer annular zone; and dropping said first material and said second material through at least one common drop hole located in a fringe range between said inner and outer annular zones.

4. The method as claimed in claim 3, wherein said first material is fed through a cylindrical outer shell of the multiple hearth furnace onto the outer periphery of said outer annular zone.

5. The method as claimed in claim 3, comprising following steps:

guiding said first material and said second material dropped through said at least one common drop hole either onto an inner zone or onto an outer zone of a lower hearth floor; and mixing said first material and said second material on said lower hearth floor by moving them from the inner zone to the outer zone, respectively from the outer zone to the inner zone, by means of rotating rabble arms.

6. The method as claimed in claim 3, wherein:

rabble arms with rabble teeth are used for moving said first material in said inner zone and said second material in said outer zone;

in said inner zone, said rabble teeth are arranged so as to move said first material outwardly; and in said outer zone, said rabble teeth are arranged so as to move said second material inwardly.

7. The method as claimed in claim 1, comprising following steps:

feeding said second material onto an inner annular zone of a hearth floor;

dropping said first material onto an outer annular zone of said hearth floor;

moving said second material in said inner annular zone of said hearth floor; and moving said first material in said outer annular zone of said hearth floor around said second material in said inner annular zone of said hearth floor.

8. The method as claimed in claim 7, wherein said first material is fed through a hollow central shaft of the multiple hearth furnace onto said inner periphery of said inner annular zone.

9. The method as claimed in claim 7, wherein said first material is fed by means of a cooled screw conveyor, which extends radially over the respective hearth floor, onto the inner periphery of said inner annular zone.

10. The method as claimed in claim 7, comprising following steps:

dropping said first material onto the outer periphery of said outer annular zone;

moving said first material in said outer annular zone inwardly towards said inner annular zone;

feeding said second material onto the inner periphery of said inner annular zone;

moving said second material in said inner annular zone outwardly towards said outer annular zone; and dropping said first material and said second material through at least one common drop hole located in a fringe range between said inner and outer annular zones.

11. The method as claimed claim 7, comprising following steps:

guiding said first material and said second material dropped through said at least one common drop hole either onto an inner zone or onto an outer zone of a lower hearth floor; and mixing said first material and said second material on said lower hearth floor by moving it from the inner zone to the outer zone, respectively from the outer zone to the inner zone, by means of rotating rabble arms.

12. The method as claimed in claim 7, wherein:

rabble arms with rabble teeth are used for moving said first material in said outer zone and said second material in said inner zone;

in said inner zone said rabble teeth are arranged so as to move said second material outwardly; and in said outer zone said rabble teeth are arranged so as to move said first material inwardly.

13. The method as claimed in claim 1, wherein:

said multiple hearth furnace comprises an first furnace stage and a second furnace stage, in which separate furnace atmospheres prevail, each stage having a plurality of vertically aligned hearth floors;

said first material comprises metal oxides;

said second material is a coal with volatile constituents;

said first material is first subjected to mainly endothermic preconditioning processes in said first furnace stage;

said coal is fed onto the lowermost hearth floor of said first furnace stage and moved thereon separately from said first material in a separate annular zone of this hearth floor, wherein most of its volatile constituents are driven off and burned in said first furnace stage; and the preconditioned first material and the preconditioned coal are fed through at least one material lock onto the uppermost hearth floor of said second furnace stage and thoroughly mixed thereon, so that said metal oxides are subjected to a reduction by said coal in said second furnace stage.

14. The method as claimed in claim 2, comprising following steps:

feeding said second material onto the outer periphery of said outer annular zone;

moving said second material separately inwardly towards said inner annular zone;

feeding said first material onto the outer periphery of said inner annular zone;

transferring said second material from said outer annular zone into the outer periphery of said inner annular zone;

moving said first material and said second material together inwardly through said inner annular zone so as to mix both materials in said inner annular zone; and dropping the mixed materials through at least one common drop hole at the inner periphery of said inner annular zone.

15. The method as claimed in claim 14, comprising following steps:

feeding said second material onto the inner periphery of said inner annular zone;

moving said second material separately outwardly towards said outer annular zone;

feeding said first material onto the inner periphery of said outer annular zone;

transferring said second material from said inner annular zone into the inner periphery of said outer annular zone;

moving said first material and said second material together outwardly through said outer annular zone so as to mix both materials in said outer annular zone; and dropping the mixed materials through at least one common drop hole at the outer periphery of said outer annular zone.

* * * * *